11/18/80 OR 4,234,815

United States Patent [19]

Credelle

[11] 4,234,815

[45] Nov. 18, 1980

[54] FLAT DISPLAY TUBE HAVING SHIELDING MEMBER BETWEEN BEAM GUIDE AND SCREEN

[75] Inventor: Thomas L. Credelle, Plainsboro, N.J.

[73] Assignee: RCA Corporation, New York, N.Y.

[21] Appl. No.: 11,555

[22] Filed: Feb. 12, 1979

[51] Int. Cl.[3] ..... H01J 29/04; H01J 31/08

[52] U.S. Cl. ..... 313/422

[58] Field of Search ..... 313/422; 315/366

[56] References Cited

U.S. PATENT DOCUMENTS

| | | | |
|---|---|---|---|
| 2,858,464 | 10/1958 | Roberts | 313/422 X |
| 4,088,920 | 5/1978 | Siekanowicz | 313/422 |
| 4,115,724 | 9/1978 | Endriz | 313/422 X |
| 4,121,130 | 10/1978 | Gange | 313/409 X |

*Primary Examiner*—Robert Segal

*Attorney, Agent, or Firm*—E. M. Whitacre; G. H. Bruestle; V. J. Coughlin

[57] ABSTRACT

An evacuated envelope includes substantially parallel front and back walls with a cathodoluminescent screen on the front wall. Within the envelope, in spaced relation to the back wall and substantially parallel to the screen, it is an electron beam guide comprising a pair of spaced apart, elongated guide grids having a plurality of apertures therethrough. At one end of the beam guide is an electron beam generating and directing means which directs at least one beam of electrons between the guide grids. A shielding member is disposed between the screen and the beam guide adjacent to the electron beam generating means.

2 Claims, 2 Drawing Figures

FLAT DISPLAY TUBE HAVING SHIELDING MEMBER BETWEEN BEAM GUIDE AND SCREEN

BACKGROUND OF THE INVENTION

The present invention relates to image display device having electron beam guides, and more particularly to a means for shielding the electron beams, as the beams enter the beam guides, from perturbing electric fields.

Recently, flat image display devices have been suggested utilizing a plurality of electron beam guides to direct electron beams to various positions on a cathodoluminescent screen. One type of these devices is described in U.S. Pat. No. 4,088,920 issued May 9, 1978 to W. W. Siekanowicz et al. entitled "Flat Display Device with Beam Guides." The electron beam guides in these devices comprises apertured plates which are biased so as to establish an electric field balance between two of the adjacent parallel plates. At the midpoint between the two adjacent plates, the electric fields are symmetrical so that an electron beam injected between the two plates will be confined by the balanced electric fields and guided in a path parallel to each of the plates. The Siekanowicz et al. patent also discloses that the display device may be provided with additional grids between the beam guides and the screen. These additional grids serve as focusing and accelerating grids for the electron beams as the beams flow from the beam guide to the phosphor screen. The potentials on the focus grid, acceleration grid, and screen electrode generate electric fields which can penetrate into the beam generating cathode region and perturb the electric fields around the cathode causing nonuniform injection of the electron beams into the beam guide. The electric fields generated by the modulation electrodes, the focusing and accelerating grids, and the screen electrode can also penetrate into the beam guide and perturb the fields in the critical transition region which extends within and along the beam guide for a longitudinal distance equal to at least the first transverse row of apertures. It is highly desirable in such display devices to shield the cathode region and the transition region from the perturbing electric fields emanating from the ends of the display device elements which cause nonuniform electron beam injection into the beam guides and also distort the balanced fields within the guides.

SUMMARY OF THE INVENTION

A display device has an evacuated envelope, a cathodoluminescent screen, a beam guide and an electron generating and directing means at one end of the beam guide. A shielding means disposed between the screen and the beam guide has its proximal end adjacent to the electron generating and directing means.

DETAILED DESCRIPTION OF THE PREFERRED EMBODIMENT

Figure 1:
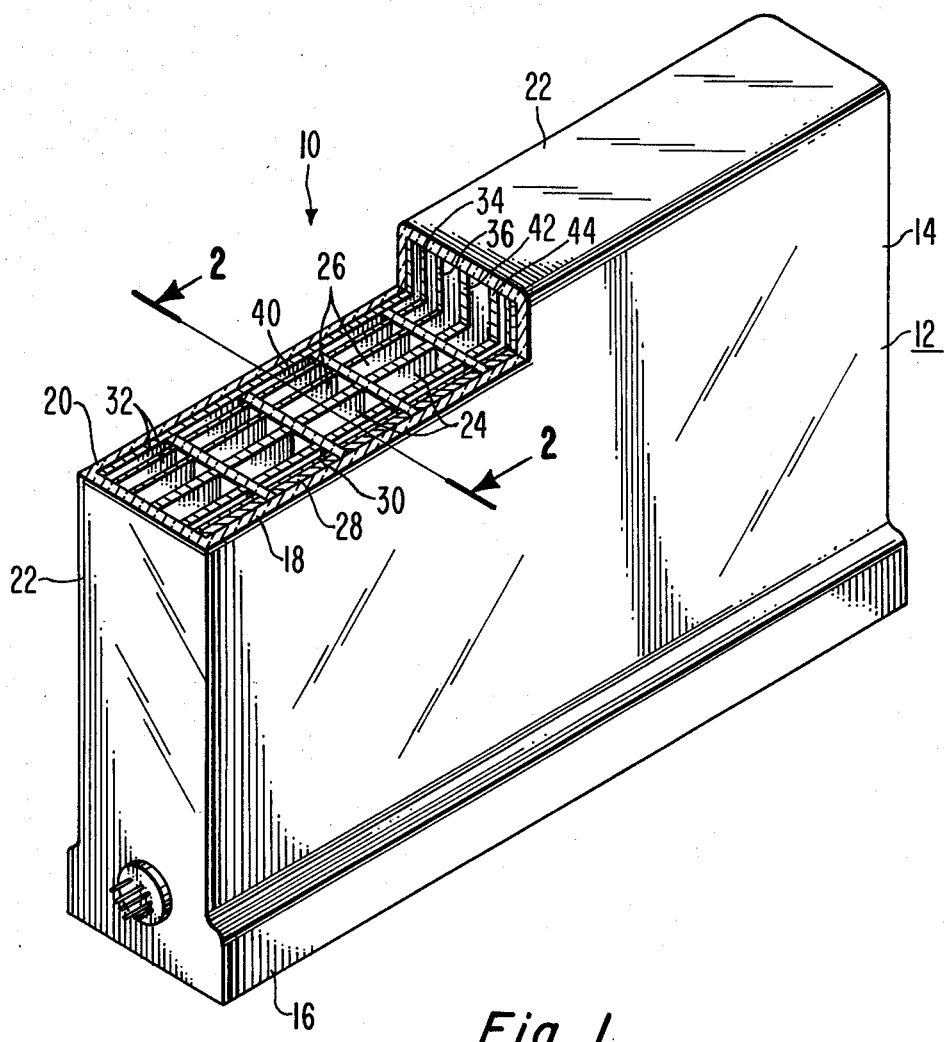
FIG. 1 is a perspective view, partially cut-away, of a display device embodying the present invention.
Figure 2:
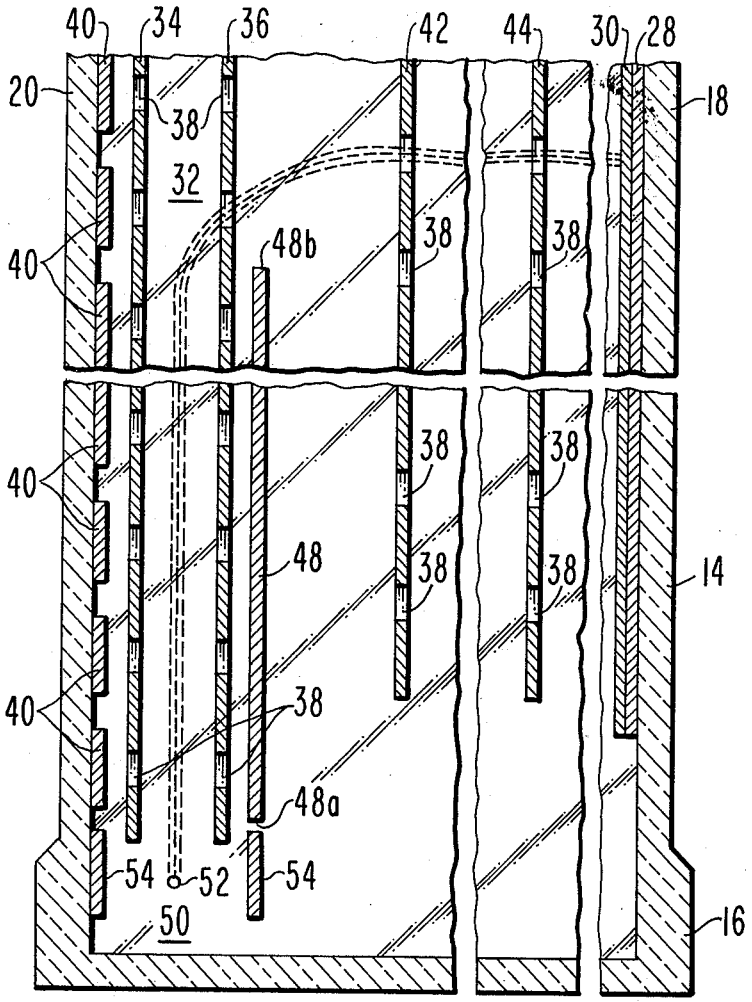
FIG. 2 is a sectional view taken along line 2—2 of FIG. 1.

Referring to FIGS. 1 and 2, one form of a flat display device utilizing the shielding member of the present invention is generally designated as 10. The display device 10 comprises an evacuated envelope 12, typically of glass, having a display section 14 and an electron gun section 16. The display section 14 includes a rectangular front wall 18 which supports a viewing screen 28 and a rectangular back wall 20 in spaced, parallel relation with the front wall 18. The front wall 18 and back wall 20 are connected by side walls 22. The front wall 18 and back wall 20 are dimensioned to provide the size of the viewing screen desired, e.g. 75 by 100 cm, and are spaced apart about 2.5 to 7.5 cm.

A plurality of spaced, parallel support walls 24 are secured between the front wall 18 and the back wall 20 and extend from the gun section 16 to the opposite side wall 22. The support walls 24 provide the desired internal support for the evacuated envelope 12 against external atmospheric pressure and divide the display section 14 into a plurality of channels 26. On the inner surface of the front wall 18 is the phosphor screen 28. The phosphor screen 28 may be of any well known type presently being used in cathode ray tubes, e.g., black and white or color television display tubes. A metal film electrode 30 is provided on the phosphor screen 28.

The gun section 16 is an extension of the display section 14 and extends along one end of the channels 26. The gun section may be of any shape suitable to enclose a particular gun structure 50 contained therein. The electron gun structure 50 contained in the gun section 16 may be of any well known construction suitable for generating at least one beam of electrons into each of the channels 26. For example, the gun structure may comprise a plurality of individual guns mounted at the ends of the channels 26 for directing separate beams of electrons into the channels. Alternatively, the gun structure 50 may include a plurality of modulation electrodes 54 and a line cathode 52 extending along the gun section 16 between the modulation electrodes 54. The line cathode 52 also extends across the ends of the channels 26 and is adapted to generate electrons which can be selectively directed as individual beams into the channels. A gun structure of the line type is described in U.S. Pat. No 4,121,130 to R. A. Gange, issued Oct. 17, 1978, entitled "Cathode Structure and Method of Operating the Same."

In each of the channels 26 is a beam guide 32 for focusing and periodically confining electrons into a beam which travels in a path along the guide 32. The guide 32 includes a pair of elongated, spaced apart, parallel first and second guide grids 34 and 36 respectively, each having a plurality of apertures 38 therethrough. The apertures 38 are arranged so as to define a plurality of rows transversely across and columns longitudinally along the guide grids 34 and 36. A plurality of spaced, parallel conductors 40 are disposed on the inner surface of the back wall 20 and extend transversely across the channels 26. The conductors 40 are strips of an electrically conductive material, such as metal, coated on the back wall 20. Each of the conductors 40 lies directly opposite a transverse row of apertures 38 in the first guide grid 34. Means are provided for deflecting the beam out of the guide and toward the phosphor screen 28 at various points along the length of the channels 26.

In each of the channels 26 a focusing grid 42 may be located in spaced relation between the beam guide 32 and the metal film electrode 30 on the phosphor screen 28. An accelerating grid 44 may be interposed between the focusing grid 42 and the metal film electrode 30. The focusing grid 42 and the accelerating grid 44 also have a plurality of apertures 38 therethrough. Grids 42 and 44 serve as focusing and accelerating means respectively, for the electron beams as the beams flow from the beam guide 32 to the phosphor screen 28.

A non-apertured shielding member 48 is fixedly attached by insulator supports (not shown) to the beam guide 32. The shielding member 48 has a proximal end 48*a* located adjacent to the electron gun structure 50. The shielding member 48 comprises an electrode located in spaced, parallel relation to the second guide grid 36. The member 48 may be made of any suitable conductive material, such as cold-rolled steel or beryllium-copper. The thickness of the member 48 is substantially identical to the thickness of the second guide grid 36. The member 48 extends transversely across the channel 26 so as to substantially shield the cathode region within the gun structure 50 and the transition region of the beam guide 32 from the ends of the focusing grid 42, the accelerating grid 44, and the metal film electrode 30. For reasons which will be explained later, the member 48 extends longitudinally along the channel 26 so as to overlap at least the first transverse row of apertures 38 and preferably the first six rows of apertures 38 in the second guide grid 36. The member 48 has a distal end 48*b* which terminates between two adjacent rows of apertures 38. The member 48 is preferably spaced from the second guide grid 36 of the beam guide 32 a distance substantially equal to the spacing between the first guide grid 34 and the conductors 40 on the back wall 20.

In the operation of the display device 10 incorporating the above described shielding member 48, a positive potential, typically about 80 volts, is applied to the first and second guide grids 34 and 36. A relatively high positive potential, typically about 350 volts, is applied to each of the conductors 40 on the back wall 20 and to the shielding member 48. A high positive potential, typically 2000 to 10,000 volts is applied to the metal film electrode 30 on the phosphor screen 28. The same high positive potential that is applied to the metal film electrode 30 may also be applied to the accelerating grid 44 if the device is provided with such an additional grid. A positive potential typically 1000 volts, which is higher than the potential applied to the first and second guide grids 34 and 36 but lower than the potential applied to the metal film electrode 30, may be applied to the focusing grid 42 if such a grid is included in the display device.

Beams of electrons are directed along paths from the gun section 16 into the channels 26 between the guide grids 34 and 36 of the beam guides 32, with each beam being directed along a longitudinal column of guide grid apertures 38. The potential difference between the guide grid 34 and the conductors 40, and the potential difference between the guide grid 36 and the metal film 30 of the phosphor screen 28 or the resultant potential on both the focusing grid 42 and the accelerating grid 44 in those devices having these additional grids, creates an electrostatic force field within the space between the guide grids 34 and 36 as described in the Siekanowicz et al. patent. This electrostatic field applies forces to confine the electrons into beams which travel along a substantially straight path between the guide grids 34 and 36.

The relatively high positive potential applied to each of the conductors 40 on the back wall 20 and to the shielding member 48 creates symmetrical electric fields in the critical transition region within the beam guide 32. The transition region is the region of the guide 32 which extends along the guide 32 for a longitudinal distance equal to at least the first transverse row of apertures. The symmetrical fields from the shielding member 48 and the conductors 40 shield out the perturbing fields which emanates from the ends of the device elements such as the modulation electrodes 54, the focusing grid 42, the accelerating grid 44, and the metal film electrode 30 and which would otherwise penetrate into the transition region of the guide 32 through the apertures 38.

The close proximity of the modulation electrodes 54 and the distal end 48*a* of the shielding member 48 also prevents the perturbing fields which emanate from the ends of the metal film electrode 30 and grids 42 and 44 from penetrating into the beam generating cathode region within the electron gun structure 50.

It has been determined that the perturbing fields from the ends of the modulation electrodes 54 have a negligible effect on the electron beams within the guide 32 if the shielding member 48 has a minimum length equal to twice the spacing between the second guide grid 36 and the focusing grid 42. Thus, if the spacing between the second guide grid 36 and the focusing grid 42 is 125 mils (3.175 mm) a shielding member 48 having a length of 250 mils (6.35 mm) would be sufficient to shield the electron beam within the guide 32 from the perturbing fields emanating from the modulation electrodes 54.

However, a length greater than the minimum length of 250 mils (6.35 mm) is required to minimize the deleterious effect of the perturbing fields emanating from the ends of the metal film electrode 30 and the grids 42 and 44 on the transition region of the guide 32. It has been determined that an additional 500 mils (12.7 mm) should be added to the minimum length of the shielding member 48 to obtain the shielding necessary for optimum device operation.

Thus, in the preferred embodiment, which has a center-to-center spacing of about 125 mils (3.18 mm) between adjacent transverse rows of apertures 38 in the beam guide 32, a shielding member 48 having a length of 750 mils (19.05 mm) would cover the first six transverse rows of apertures 38 of the beam guide 32. As shown in FIG. 2, the ends of the grids 42 and 44 and the metal film electrode 30 should overlap the distal end 48*b* of the shielding member 48 by about 500 mils (12.7 mm) so that the electric field balance within the transition region of the beam guide 32 is not adversely affected by the perturbing fields emanating from the ends of the abovementioned elements 30, 42 and 44.

The distal end 48*b* of the shielding member 48 should terminate between adjacent transverse rows of apertures 38 in the second guide grid 36 in order to minimize the edge effect of the electric field from the shielding member 48 on the field balance within the beam guide 32.

While the shielding member 48 is described above as being spaced from the second guide grid 36 a distance that is approximately equal to the spacing from the first guide grid 34 to the conductors 40 on the back wall 20, it should be clear that this spacing, while preferred, is selected to permit the same potential to be applied to the member 48 and the conductors 40 to create symmetrical electric fields in the transition region of the beam guide 32. The spacing between the shielding member 48 and the second guide grid 36 may either be increased or decreased from the preferred spacing provided the potential applied to the member 48 is also changed to re-establish field symmetry in the transition region.

Where the spacing between the second guide grid 36 and the focusing grid 42, or the screen electrode 30 in a device not having a focusing grid 42, is decreased from that preferred spacing indicated above, the minimum length of the shielding member 48 should be sufficient to overlap at least the first transverse row of apertures 38 in the second guide grid 36. The shielding member 48 should terminate between the adjacent transverse row of apertures 38 in the second guide grid 36 for the reason discussed above.

I claim:

1. In a display device having an evacuated envelope with substantially parallel front and back walls, a cathodoluminescent screen on the front wall, an electron beam guide in spaced relation to said back wall, said beam guide being disposed substantially parallel to said screen, said beam guide comprising a pair of spaced apart, elongated guide grids having a plurality of apertures therethrough, said apertures being arranged so as to define a plurality of rows across and columns along said guide grids, means at one end of said beam guide for generating and directing at least one beam of electrons between said guide grids, the improvement comprising:

conductive shielding means in spaced parallel relationship to said beam guide having a proximal end adjacent to said electron generating and directing means, said shielding means being disposed between said screen and said beam guide and extending along said beam guides so as to overlap at least the first row of apertures on the screen side of said beam guide, said shielding means having a distal end which terminates between adjacent rows of apertures.

2. The device as in claim 1, wherein said shielding means is spaced from the screen side of said beam guide a distance equal to the spacing between the back wall side of said beam guide and the back wall.

* * * * *